US010813467B2

(12) United States Patent
Jin

(10) Patent No.: US 10,813,467 B2
(45) Date of Patent: Oct. 27, 2020

(54) FOLDABLE BED FRAME HAVING LEGS ROTATABLE IN LATERAL DIRECTION

(71) Applicant: Luhua (Xiamen) Trading Co., Ltd., Xiamen (CN)

(72) Inventor: Juyoung Jin, Xiamen (CN)

(73) Assignee: Xiamen Innovation Metal Products Co., Ltd., Xiamen (CN)

( * ) Notice: Subject to any disclaimer, the term of this patent is extended or adjusted under 35 U.S.C. 154(b) by 657 days.

(21) Appl. No.: 15/423,251

(22) Filed: Feb. 2, 2017

(65) Prior Publication Data

US 2017/0215597 A1 Aug. 3, 2017

(30) Foreign Application Priority Data

Feb. 2, 2016 (CN) ..... 2016 2 0103546 U
Feb. 2, 2016 (CN) ..... 2016 2 0103552 U

(51) Int. Cl.
*A47C 19/00* (2006.01)
*A47C 19/12* (2006.01)

(52) U.S. Cl.
CPC ..... *A47C 19/122* (2013.01)

(58) Field of Classification Search
CPC ..... A47C 19/12; A47C 19/128; A47C 19/122; A47C 19/124; A47C 19/126; A47C 19/005; A47C 19/20; A47C 19/045; A47C 19/04; A47C 19/028; A47C 19/027; A47C 19/025; A47C 19/024; A47C 19/02; A47C 19/00

See application file for complete search history.

(56) References Cited

U.S. PATENT DOCUMENTS 190,338 A * 5/1877 Hall ..... A47C 19/122 5/179
261,770 A * 7/1882 Segar ..... A47C 19/126 5/116
478,761 A * 7/1892 Rodecap ..... A47C 19/122 5/174
605,126 A 6/1898 Odell
767,680 A * 8/1904 Barton ..... A47C 19/128 5/178

(Continued)

FOREIGN PATENT DOCUMENTS

JP 2005-28000 A 2/2005

OTHER PUBLICATIONS

U.S. Appl. No. 15/144,575, filed May 2, 2016.

(Continued)

*Primary Examiner* — Peter M. Cuomo
*Assistant Examiner* — Ifeolu A Adeboyejo
(74) *Attorney, Agent, or Firm* — Morgan, Lewis & Bockius LLP

(57) ABSTRACT

A foldable bed frame includes first and second sub-frames, and a plurality of leg assemblies. The first and second sub-frames are pivotally connected to each other at their proximal sides. The plurality of leg assemblies includes a first leg assembly disposed at a distal side of the first sub-frame, and a second leg assembly disposed at a distal side of the second sub-frame. Each of the first and second leg assemblies includes left and right legs disposed at left and right sides of the foldable bed frame, respectively, and able to rotate in a lateral direction of the foldable bed frame toward or away from each other.

18 Claims, 19 Drawing Sheets

(56) References Cited

U.S. PATENT DOCUMENTS 802,390 A * 10/1905 Gusdorf ..... A47C 19/122 5/174
1,070,525 A 8/1913 Pieper
1,196,253 A 8/1916 Lowy
1,218,868 A 3/1917 Jones
1,259,825 A 3/1918 Basile
1,360,983 A 11/1920 Burton
1,367,173 A 2/1921 Felix
1,530,726 A 3/1925 Koenigkramer
1,574,659 A 2/1926 Johnston
2,513,168 A 6/1950 Gottlieb
2,651,787 A 9/1953 Piliero
2,671,229 A 3/1954 Vernier
2,678,085 A 5/1954 De Minno
2,701,603 A 2/1955 Coopersmith
2,782,075 A 2/1957 Fagan
2,888,688 A 6/1959 Bereman
3,108,291 A 10/1963 Eason
3,245,363 A 4/1966 Kanitz
3,295,149 A 1/1967 Hall
3,967,330 A 7/1976 Zawadowsky
4,048,683 A 9/1977 Chen
4,594,743 A 6/1986 Owen
4,620,336 A 11/1986 Miller
4,654,905 A 4/1987 Miller
5,517,744 A * 5/1996 Moser ..... B21D 39/044 29/525
5,608,930 A 3/1997 Chen
5,894,614 A 4/1999 Stroud
6,151,730 A 11/2000 Weston
6,230,344 B1 5/2001 Thompson
6,643,900 B2 11/2003 Jahrling
7,376,989 B2 5/2008 Wickstrom
7,406,727 B2 8/2008 Wickstrom
7,428,872 B2 9/2008 Strong et al.
7,503,086 B2 3/2009 Wickstrom
8,312,576 B1 11/2012 Oh
8,370,973 B1 2/2013 Oh
8,707,478 B2 4/2014 Jin
8,769,740 B2 7/2014 Oh
8,898,832 B2 12/2014 Oh
8,978,176 B1 * 3/2015 Oh ..... A47C 19/005 5/200.1
9,027,181 B1 * 5/2015 Yu ..... A47C 17/16 5/202
9,226,590 B1 1/2016 Hull
9,314,386 B1 4/2016 Boyd
9,456,699 B1 10/2016 Oh
9,526,347 B2 12/2016 Boyd
9,538,850 B2 1/2017 Oh
9,907,405 B2 3/2018 An
10,034,551 B2 7/2018 Hull
10,123,629 B2 11/2018 Choi
10,285,506 B2 5/2019 Choi
10,321,767 B2 6/2019 Jin
2003/0039506 A1 2/2003 Chen
2005/0251911 A1 11/2005 Wickstrom
2006/0195982 A1 9/2006 Cloer
2006/0230532 A1 10/2006 Wickstrom
2008/0000024 A1 1/2008 Peixin
2009/0133191 A1 5/2009 Harrow
2009/0293193 A1 12/2009 Neatherry
2010/0115696 A1 5/2010 Felix, Jr.
2010/0235989 A1 * 9/2010 Jin ..... A47C 19/126 5/174
2010/0299831 A1 12/2010 Lee
2011/0073723 A1 3/2011 Ashpole
2011/0099712 A1 * 5/2011 Jin ..... A47C 19/122 5/174
2012/0042449 A1 2/2012 Hull
2012/0222216 A1 9/2012 Jin
2012/0246826 A1 * 10/2012 Jin ..... A47C 19/04 5/400
2013/0067659 A1 3/2013 Oh
2013/0067862 A1 3/2013 Oh
2013/0276229 A1 10/2013 Hsieh
2014/0345044 A1 11/2014 Murphy
2015/0143630 A1 5/2015 Harrow
2015/0320225 A1 11/2015 Boyd
2016/0143447 A1 5/2016 Hull
2016/0206112 A1 * 7/2016 Oh ..... A47C 19/126
2016/0262547 A1 9/2016 Jin
2016/0281770 A1 9/2016 Vankoughnett
2016/0302582 A1 10/2016 Oh
2016/0302583 A1 10/2016 Oh
2016/0316922 A1 11/2016 Choi
2017/0119166 A1 5/2017 An
2017/0325592 A1 11/2017 Suh
2018/0116412 A1 5/2018 Jin
2019/0045938 A1 2/2019 Skaggs

OTHER PUBLICATIONS

U.S. Appl. No. 15/144,471, filed May 2, 2016.
U.S. Appl. No. 15/056,150, filed November Feb. 29, 2016.
U.S. Appl. No. 15/820,754, filed Nov. 22, 2017.
U.S. Appl. No. 15/820,848, filed Nov. 22, 2017.
U.S. Appl. No. 15/640,810, filed Jul. 3, 2017.
U.S. Appl. No. 15/663,522, filed Jul. 28, 2017.
U.S. Appl. No. 15/809,161, filed Nov. 10, 2017.

* cited by examiner

FOLDABLE BED FRAME HAVING LEGS ROTATABLE IN LATERAL DIRECTION

CROSS-REFERENCE TO RELATED APPLICATIONS

The present application claims priority to Chinese Utility Model Applications: CN 201620103546.4 filed Feb. 2, 2016, and CN 201620103552.X filed Feb. 2, 2016. The disclosure of each of these applications is incorporated herein for all purposes by reference.

FIELD OF THE INVENTION

The present invention generally relates to foldable beds and foldable bed frames. More particularly, the present invention relates to foldable bed frames having legs rotatable in the lateral directions of the foldable bed frames.

BACKGROUND

Foldable beds have become increasingly popular. A foldable bed generally includes a foldable bed frame having support legs, and a mattress placed on the foldable bed frame. Support legs of many current foldable bed frames are foldable in the longitudinal directions of the bed frames. One example is disclosed in the Chinese Patent No. 201520009995.8, entitled "Foldable Bed." The foldable bed includes a mattress and a foldable bed frame. The bed frame includes an outer frame, and support legs installed on the outer frame and rotatable in the longitudinal direction of the bed frame. As a result, the foldable bed tends to shake in the longitudinal direction when a user gets on the bed, and in some cases may collapse and consequently the user may be injured.

Given the current state of the art, there remains a need for foldable bed frames and foldable beds that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides foldable bed frames that are stable and safe to use.

In various embodiments, the present invention provides a foldable bed frame including first and second sub-frames, and a plurality of leg assemblies. The first and second sub-frames are pivotally connected to each other at proximal sides thereof. The plurality of leg assemblies includes a first leg assembly disposed at a distal side of the first sub-frame, and a second leg assembly disposed at a distal side of the second sub-frame. Each of the first and second leg assemblies includes left and right legs disposed at left and right sides of the foldable bed frame, respectively, and able to rotate in a lateral direction of the foldable bed frame toward or away from each other.

In some embodiments, the plurality of leg assemblies further includes a middle leg assembly disposed between the first and second sub-frames and rotatably coupled to the first and second sub-frames.

In many embodiments, each of the first and second sub-frames includes: a left longitudinal bar, a right longitudinal bar, a distal lateral bar, a first inner lateral bar, a first left rotating bar, and a first right rotating bar. The distal lateral bar is coupled to distal ends of the left and right longitudinal bars. The first inner lateral bar is disposed adjacent the distal lateral bar, and has a left end coupled to the left longitudinal bar and a right end coupled to the right longitudinal bar. The first left rotating bar is disposed adjacent the left longitudinal bar, and has a first end rotatably coupled to the distal lateral bar and a second end rotatably coupled to the first inner lateral bar. The first right rotating bar is disposed adjacent the right longitudinal bar, and has a first end rotatably coupled to the distal lateral bar and the second end rotatably coupled to the first inner lateral bar. Upper ends of the left and right legs of the first or second leg assembly are fixedly coupled to the first left and right rotating bars, respectively.

In an exemplary embodiment, each of the first and second sub-frames further includes one or more inner lateral bars, each having a left end coupled to the left longitudinal bar and a right end coupled to the right longitudinal bar. In various embodiments, the left longitudinal bar, the right longitudinal bar, and the distal lateral bar are integrally formed and collectively form a U-shaped outer frame.

In some embodiments, each of the first and second sub-frames further includes: a proximal lateral bar, a second inner lateral bar, a second left rotating bar, and a second right rotating bar. The proximal lateral bar is coupled to proximal ends of the left and right longitudinal bars. The second inner lateral bar is disposed adjacent the proximal lateral bar, and has a left end coupled to the left longitudinal bar and a right end coupled to the right longitudinal bar. The second left rotating bar is disposed adjacent the left longitudinal bar, and has a first end rotatably coupled to the proximal lateral bar and a second end rotatably coupled to the second inner lateral bar. The second right rotating bar is disposed adjacent the right longitudinal bar, and has a first end rotatably coupled to the proximal lateral bar and the second end rotatably coupled to the second inner lateral bar. In such embodiments, the plurality of leg assemblies further includes a third leg assembly disposed at the proximal side of the first sub-frame, and a fourth leg assembly disposed at the proximal side of the second sub-frame. Each of the third and fourth leg assemblies includes left and right legs disposed at left and right sides of the foldable bed frame, respectively, and able to rotate in the lateral direction of the foldable bed frame toward or away from each other.

In many embodiments, each of the first and second ends of the first left and right rotating bars has a cross section of an oval shape with a longer axis and a shorter axis. Corresponding to each of the first ends of the first left and right rotating bars, the distal lateral bar includes a hole of an oval shape with a longer axis and a shorter axis. Corresponding to each of the second ends of the left and right rotating bars, the first inner lateral bar includes a hole of an oval shape with a longer axis and a shorter axis. The first and second ends of the first left and right rotating bars are received in the holes of the distal and first inner lateral bars, and are press-fitted with the corresponding holes of the distal and first inner lateral bars when the longer axes of the first and second ends of the first left and right rotating bars are aligned with the shorter axes of the corresponding holes of the distal and inner lateral bars.

In some embodiments, each of the first left and right rotating bars has a cross section of an oval shape with a longer axis and a shorter axis. Corresponding to each of the first left and right rotating bars, the distal lateral bar includes a hole of an oval shape with a longer axis and a shorter axis, and the first inner lateral bar includes a hole of an oval shape with a longer axis and a shorter axis. The first and second ends of the first left and right rotating bars are received in the holes of the distal and first inner lateral bars, and are press-fitted with the corresponding holes of the distal and first inner lateral bars when the longer axes of the first left and right rotating bars are aligned with the shorter axes of the corresponding holes of the distal and inner lateral bars.

In an exemplary embodiment, the length of the longer axis of each of the first ends of the first left and right rotating bars is equal to the length of the shorter axis of the corresponding hole of the distal lateral bar, and the length of the longer axis of each of the second ends of the first left and right rotating bars is equal to the length of the shorter axis of the corresponding hole of the inner lateral bar.

In many embodiments, the bed frame of the present invention further includes a plurality of supports, each having a first end fixedly coupled to the left or right leg and a second end fixedly coupled to the corresponding first left or right rotating bar.

In some embodiments, each of the first, second, third and fourth leg assemblies further includes an adjustable lateral bar having a left end connected to the left leg and a right end connected to the right leg. In some embodiments, the adjustable lateral bar includes first and second tubes telescopically coupled to each other and a fastening means for fixing the first tube to the second tube.

In some embodiments, each of the first, second, third and fourth assemblies further includes a left leg base removably coupled to the left leg and a right leg base removably coupled to the right leg. In some embodiments, each of the first, second, third and fourth assemblies further includes a base lateral bar having a left end connected to the left leg base and a right end connected to the right leg base.

The bed frames of the present invention have other features and advantages that will be apparent from or are set forth in more detail in the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Figure 1:
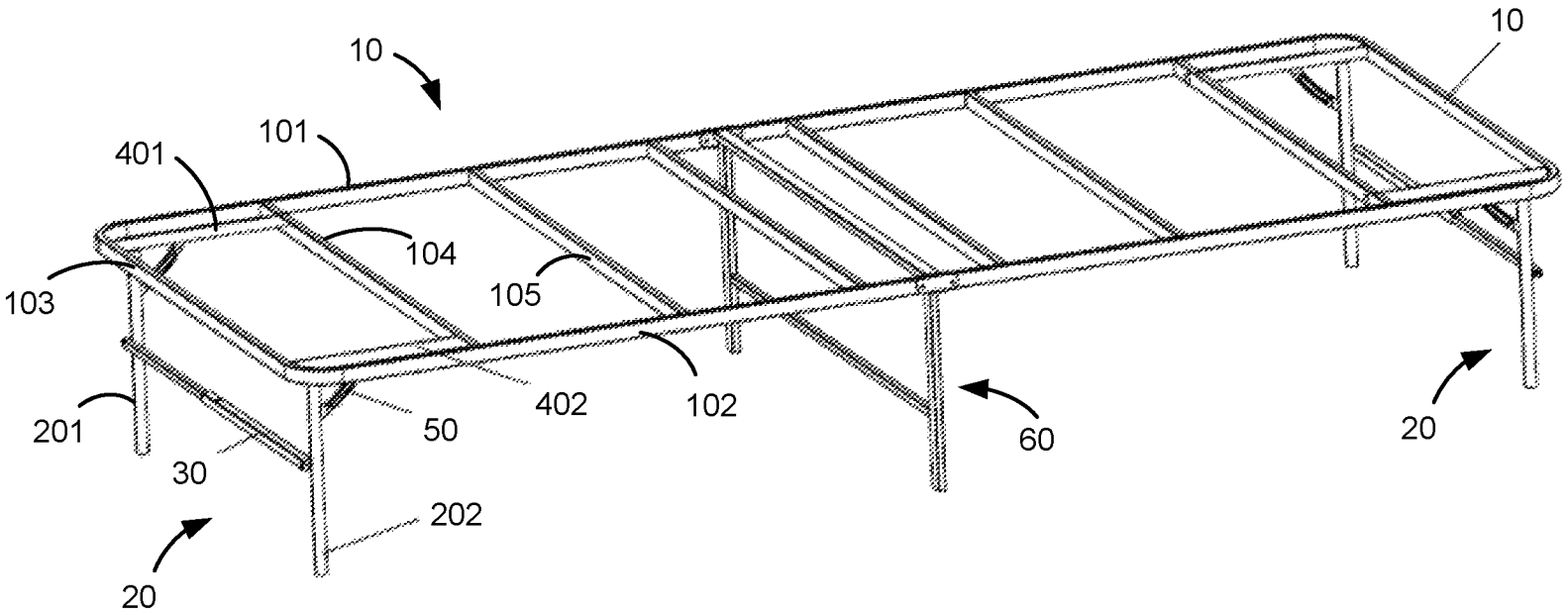
FIG. 1 is a perspective top view illustrating a foldable bed frame in an unfolded state in accordance with exemplary embodiments of the present invention.

Reference will now be made in detail to implementations of the exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the embodiments set forth in this disclosure can be made without departing from the spirit and scope of the embodiments, as will be apparent to those skilled in the art. The specific embodiments described herein are offered by way of example only.

Embodiments of the present invention are described in the context of foldable bed frames. The bed frames are of various sizes including but not limited to twin, full, queen and king sizes, and of various shapes including but not limited to rectangles and squares. Also, the bed frames can be made of various materials including but not limited to metals such as steel, plastics and woods.

Generally, a bed frame of the present invention includes a plurality of sub-frames such as first and second sub-frames 10 and a plurality of leg assemblies such as first and second leg assemblies 20. First and second sub-frames 10 are pivotally connected to each other at their proximal sides. First and second leg assemblies 20 are disposed respectively at the distal sides of first and second sub-frames 10, and support the sub-frames when the foldable bed frame is unfolded.

As used herein, the sides at which first and second sub-frames 10 are connected to each other are referred to as their proximal sides, and the sides opposite the proximal sides are referred to as their distal sides. For instance, in FIGS. 1 and 2, the proximal sides of first and second sub-frames are in the middle of the foldable bed frame. The distal sides correspond to head and foot sections of the bed frame. The other two sides are referred to as left and right sides. It should be noted that the term "middle" as used herein does not necessarily mean the center of the bed frame, and the term "side" does not necessarily mean an outmost edge of the bed frame.

Figure 2:
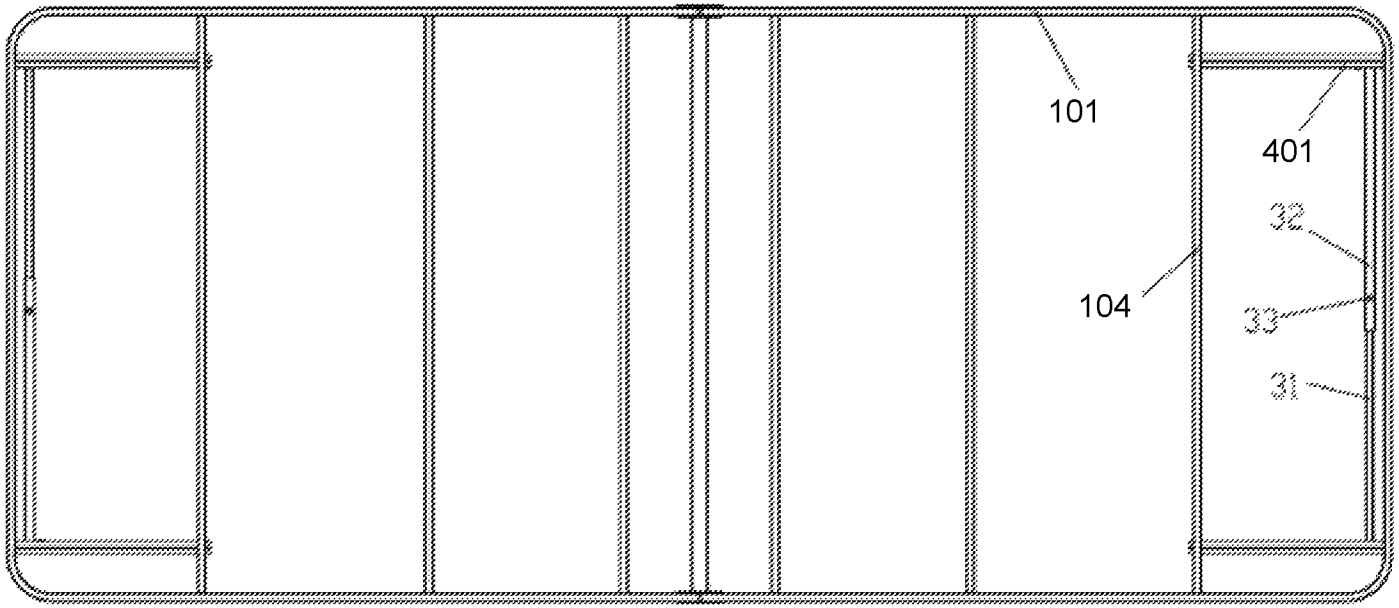
FIG. 2 is a schematic top view illustrating the foldable bed frame of FIG. 1.

Referring now to FIGS. 1 and 2, there is depicted an exemplary foldable bed frame 1 in accordance with various embodiments of the present invention. As shown, foldable bed frame 1 includes first and second sub-frames 10, and first and second leg assemblies 20. First and second sub-frames 10 are pivotally connected to each other at their proximal sides. First and second leg assemblies 20 are disposed at distal sides of the first and second sub-frames, respectively.

In some embodiments, each of first and second sub-frames 10 includes left longitudinal bar 101, right longitudinal bar 102, and distal lateral bar 103 coupled to distal ends of the left and right longitudinal bars. Each of first and second sub-frames 10 also includes first inner lateral bar 104 disposed adjacent the distal lateral bar, and having a left end coupled to the left longitudinal bar and a right end coupled to the right longitudinal bar.

By way of illustration, FIGS. 1 and 2 show that the left and right longitudinal bars are substantially straight and parallel to each other, and the distal and first inner lateral bar are substantially straight and parallel to each other. It would be appreciated that these bars can be straight, curved, and/or angled (e.g., not parallel) with each other. The bars can be hollow or solid. In an embodiment, the left longitudinal bar, the right longitudinal bar, and the distal lateral bar are integrally made and collectively form a U-shaped outer frame.

In some embodiments, each of the first and second sub-frames further includes first left rotating bar 401 disposed adjacent the left longitudinal bar and first right rotating bar 402 disposed adjacent the right longitudinal bar. First left rotating bar 401 has a first end rotatably coupled to the distal lateral bar and a second end rotatably coupled to the first inner lateral bar. First right rotating bar 402 has a first end rotatably coupled to the distal lateral bar and the second end rotatably coupled to the first inner lateral bar.

Figure 9:
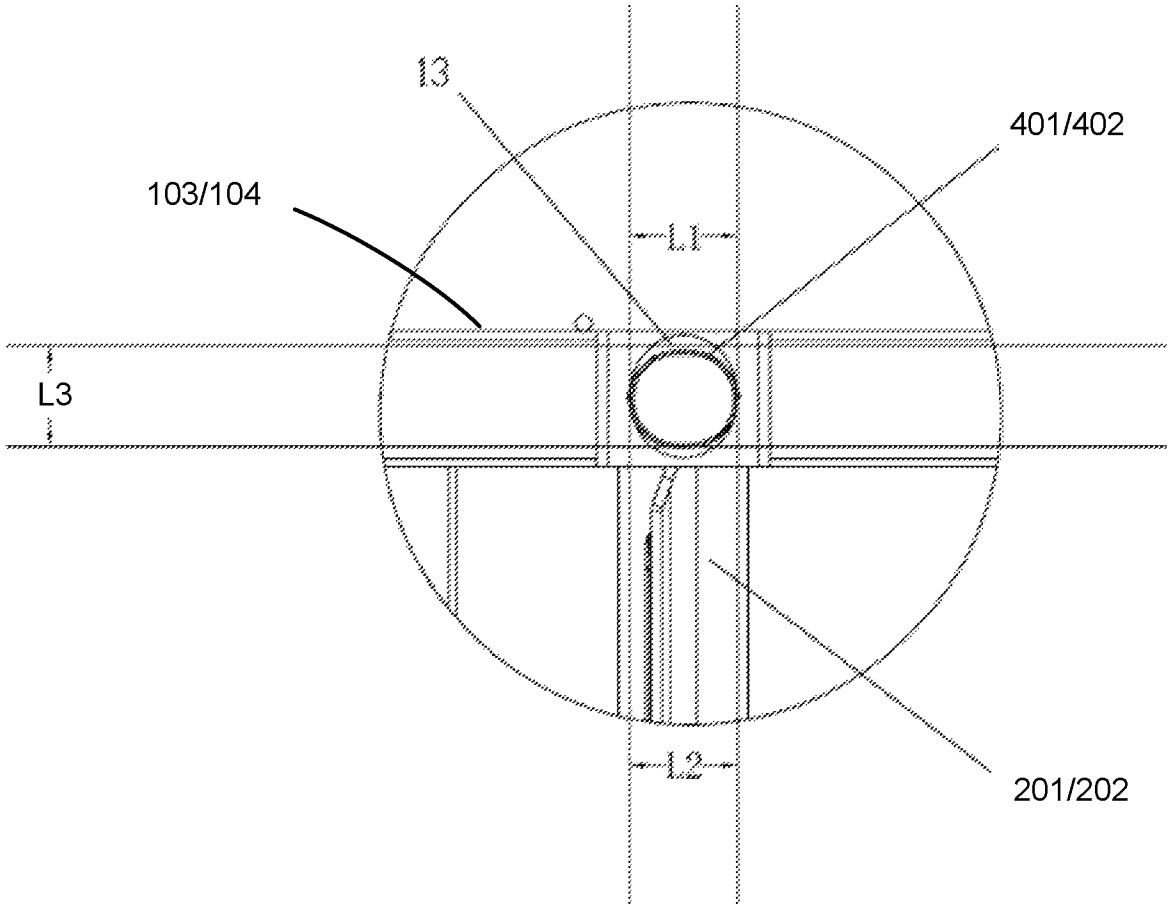
FIGS. 9-11 are schematic views illustrating coupling of a rotating bar with a lateral bar in accordance with exemplary embodiments of the present invention.
Figure 10:
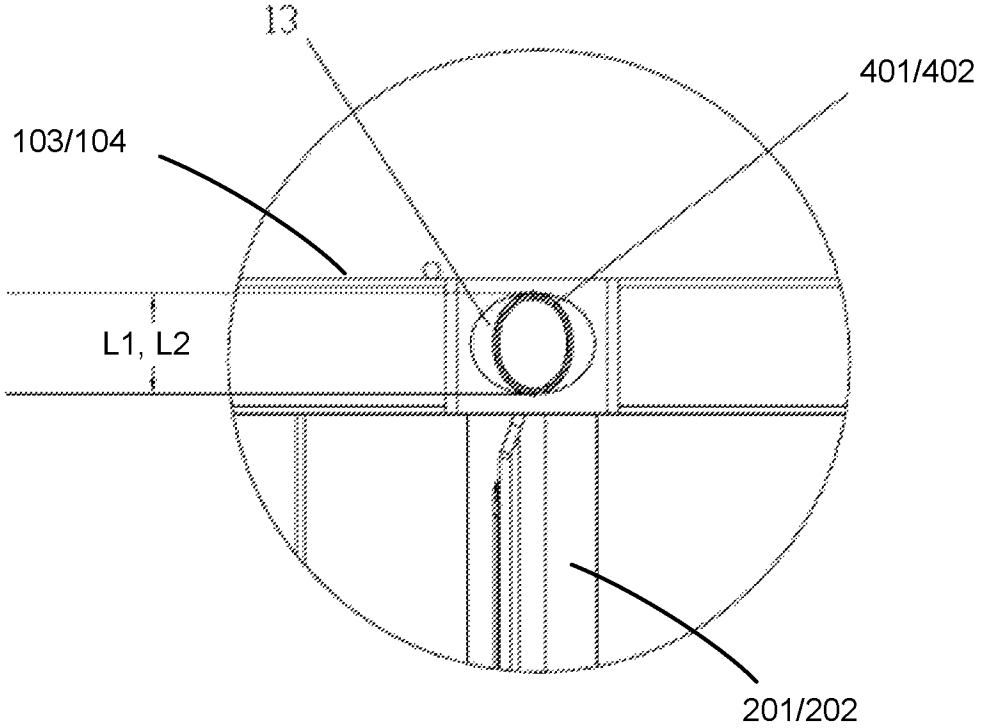
Figure 11:
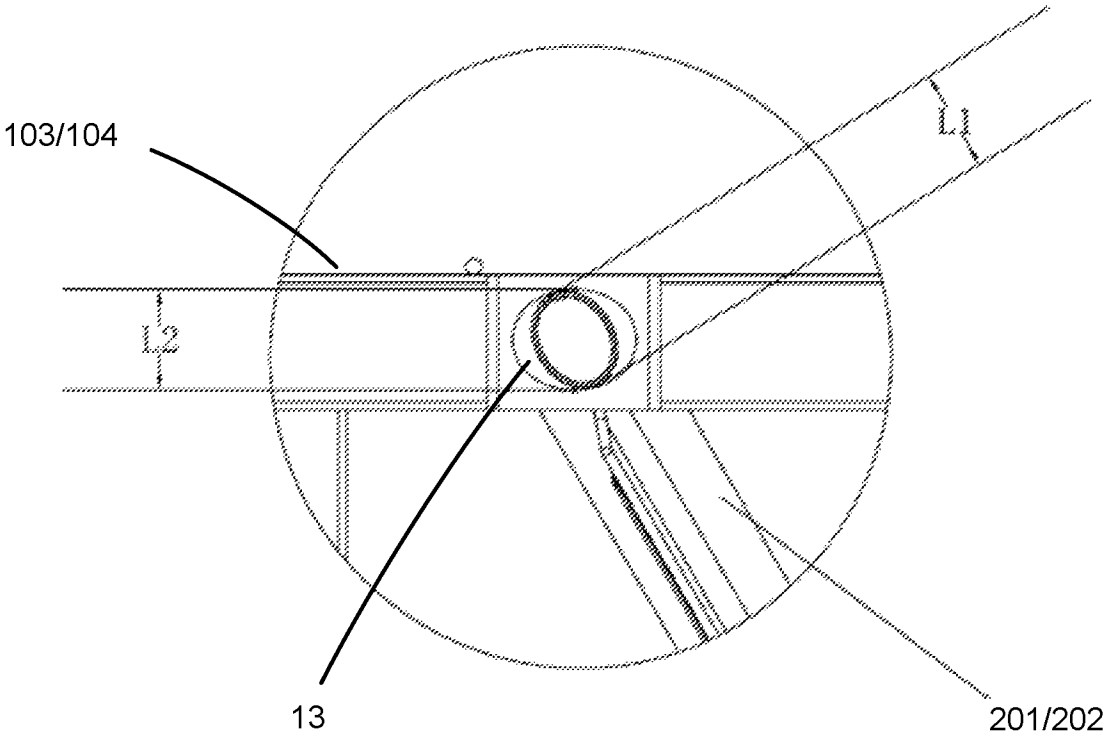

Referring to FIGS. 9-11, there is depicted exemplary rotational couplings of a rotating bar (e.g., left or right rotating bar 401/402) with a lateral bar (e.g., distal or first inner lateral bar 103/104) in accordance with some embodiments of the present invention. As shown, the end of the rotating bar (e.g., the first or the second end used for coupling to the lateral bar) is configured to have a cross section of an oval or elliptical shape with a longer axis L1 and a shorter axis L3 (e.g., the length L1 of the longer axis is relatively larger than the length L3 of the shorter axis). Corresponding to the end of the rotating bar, the lateral bar is formed with hole 13 for receiving the end of the rotating bar. Hole 13 has an oval shape with a longer axis, and a shorter axis L2. The length of the shorter axis L2 of hole 13 equals or approximately equals to the length of the longer axis L1 of the rotational bar. As such, the rotating bar can rotate easily in hole 13 at certain positions, whereas when the longer axis L1 of the rotational bar aligns or substantially aligns with the shorter axis L2 of hole 13, the end of the rotating bar is press-fitted with hole 13 and thus locked in place. In an embodiment such as that illustrated in FIG. 9, the shorter axis L2 of hole 13 is horizontal when the bed frame is unfolded. In an embodiment such as that illustrated in FIGS. 10 and 11, the shorter axis L2 of hole 13 is vertical when the bed frame is unfolded.

As used herein, the term "oval shape" refers to any suitable shape having a longer axis and a shorter axis, including but not limited to oval, oblong, elliptical, or similar shapes. It should be noted that the first end and the second end of a rotating bar can have the same oval shape or different oval shapes (e.g., different sizes or shapes). Similarly, the holes formed on the lateral bars and corresponding to the first end and the second end of a rotating bar can have the same oval shape or different oval shapes.

In some embodiments, the entire rotating bar is of an oval shape. In an embodiment, each of the first left and right rotating bars has a cross section of an oval shape with a longer axis and a shorter axis. Corresponding to each of the first left and right rotating bars, the distal lateral bar includes a hole of an oval shape with a longer axis and a shorter axis, and the first inner lateral bar includes a hole of an oval shape with a longer axis and a shorter axis. The first and second ends of the first left and right rotating bars are received in the holes of the distal and first inner lateral bars, and are press-fitted with the corresponding holes of the distal and first inner lateral bars when the longer axes of the first left and right rotating bars are aligned with the shorter axes of the corresponding holes of the distal and inner lateral bars.

Referring to FIGS. 1, 2 and 9-11, leg assembly 20 includes a left leg such as left leg 201 disposed at the left side of the foldable bed frame and a right leg such as right leg 202 disposed at the right side of the foldable bed frame. In some embodiments, the upper end of left leg 201 of the first or second leg assembly is fixedly coupled (e.g., by welding, fastening, or the like) to first left rotating bar 401, and the upper end of right leg 202 of the first or second leg assembly is fixedly coupled to first right rotating bar 402. As such, when first and right rotating bars 401, 402 rotate, left leg 201 and right leg 202 rotate along with first and right rotating bars 401, 402, i.e., rotating in a lateral direction of the foldable bed frame toward or away from each other. When the longer axes L1 of the rotational bars align with the shorter axes of holes 13 of the lateral bars, the rotating bars is press-fitted with holes 13, thereby locking the left and right legs in place.

In some embodiments, each of the first and second leg assemblies further includes an adjustable lateral bar, such as adjustable lateral 30 illustrated in FIG. 1. Adjustable lateral 30 has a left end connected to left leg 201 and a right end connected to right leg 202. In an embodiment, adjustable lateral bar 30 includes first and second tubes 31, 32 telescopically coupled to each other, and fastener 33 configured to fasten the first tube with the second tube, as illustrated in FIG. 2. In some embodiments, first tube 31 (or a portion of first tube 31) is smaller than second tube 32 (or a portion of second tube 32) such that the first tube can be inserted into the second tube. In an embodiment, each of the first and second tubes is formed with a through hole on its side wall, and fastener 33 includes an elastic member disposed inside of the first tube. The elastic member includes a clip, latch, lock, buckle or the like that couples the through holes of the first and second tubes, thereby fastening the first and second tubes together. When fastened, the length of adjustable lateral bar 30 is fixed, and cannot be extended or contracted. As such, adjustable lateral bar 30 when fastened prevents left and right legs 201, 202 from shaking, warping or rotating in the lateral direction of the foldable bed frame, thereby making the bed frame more stable. In various embodiments, in an unfolded state, left and right legs 201, 202 are perpendicular or substantially perpendicular to sub-frames 10, and support the sub-frames.

In some embodiments, bed frame 1 further includes a plurality of supports such as supports 50. In a representative embodiment, each support 50 is disposed between a leg (e.g., first right leg 202) and a corresponding rotating bar (e.g., first right rotating bar 402), and fixedly coupled to the leg at one end and fixedly coupled to the corresponding rotating bar at the other end. Supports 50 help to stabilize left and right legs 201, 202, and reduce shaking and rotation in the longitudinal direction of the bed frame.

In an exemplary embodiment, the plurality of leg assemblies further includes a middle leg assembly such as middle leg assembly 60 disposed between the first and second sub-frames and rotatably coupled to the first and second sub-frames. In an embodiment, the first or second sub-frame, or each of the first and second sub-frames further includes one or more inner lateral bars such as inner lateral bar 105, each of which has a left end coupled to the left longitudinal bar and a right end coupled to the right longitudinal bar.

Figure 3:
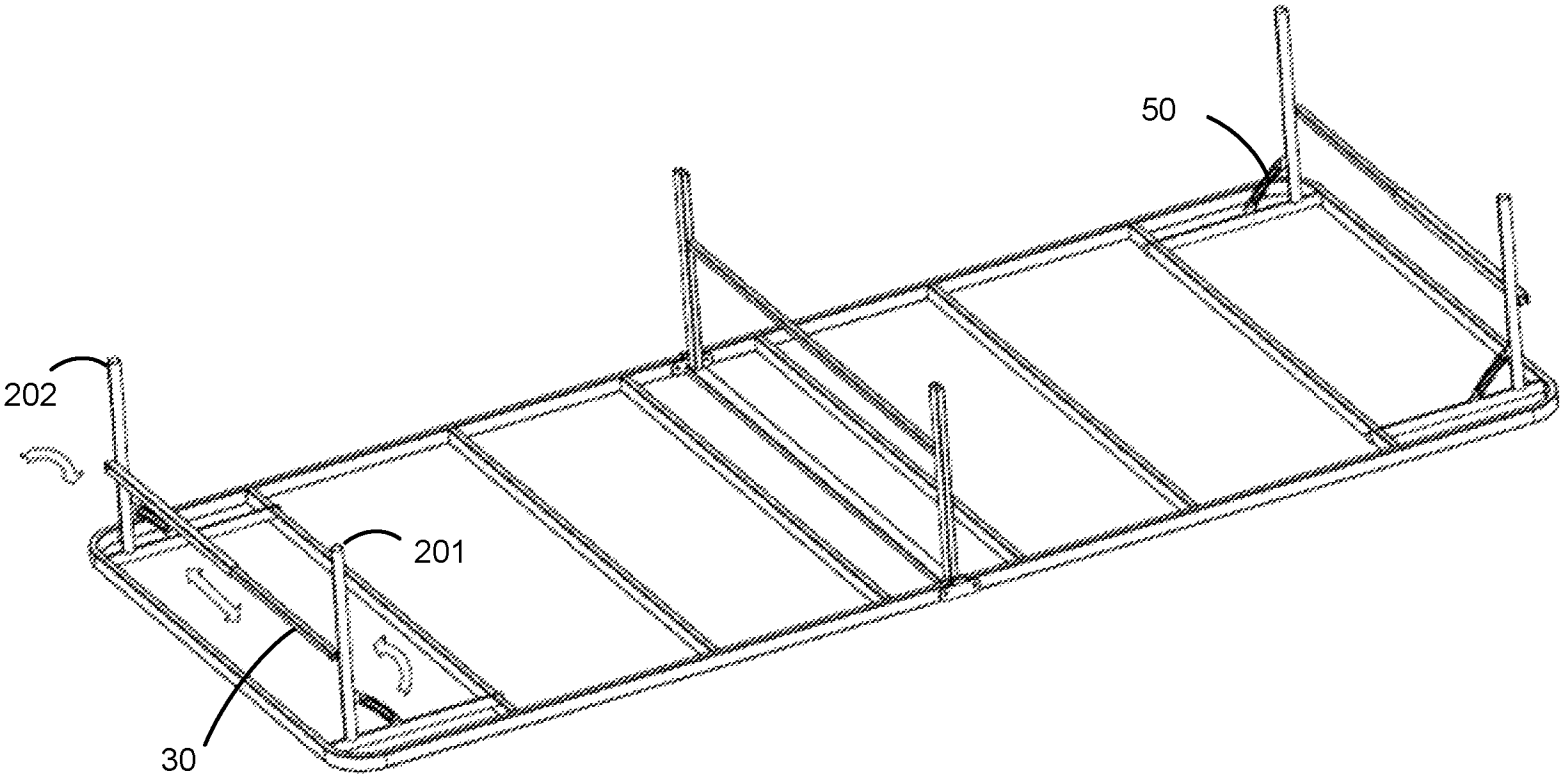
FIGS. 3-7 are perspective views illustrating exemplary folding processes of the foldable bed frame of FIG. 1.
Figure 4:
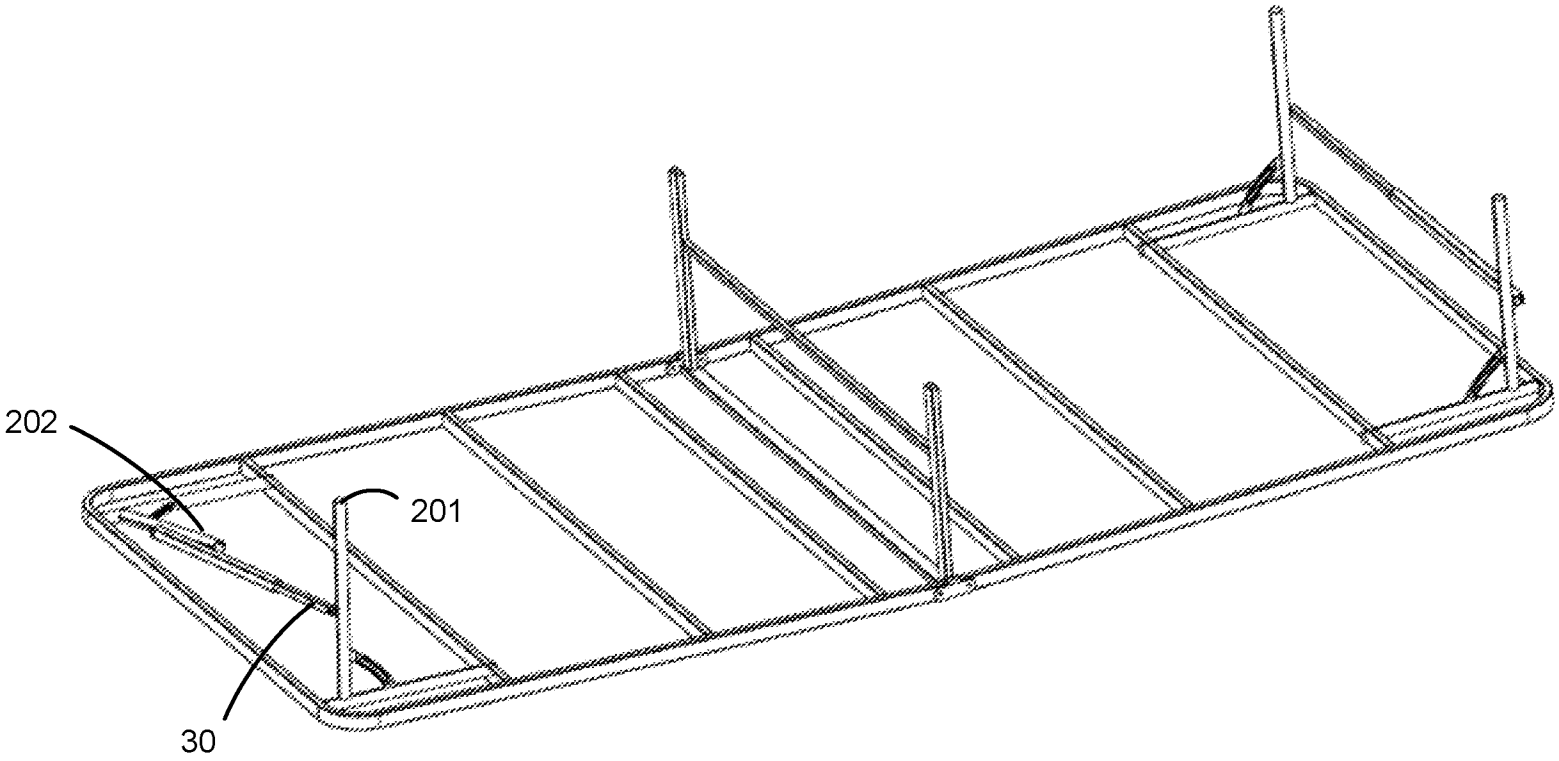
Figure 5:
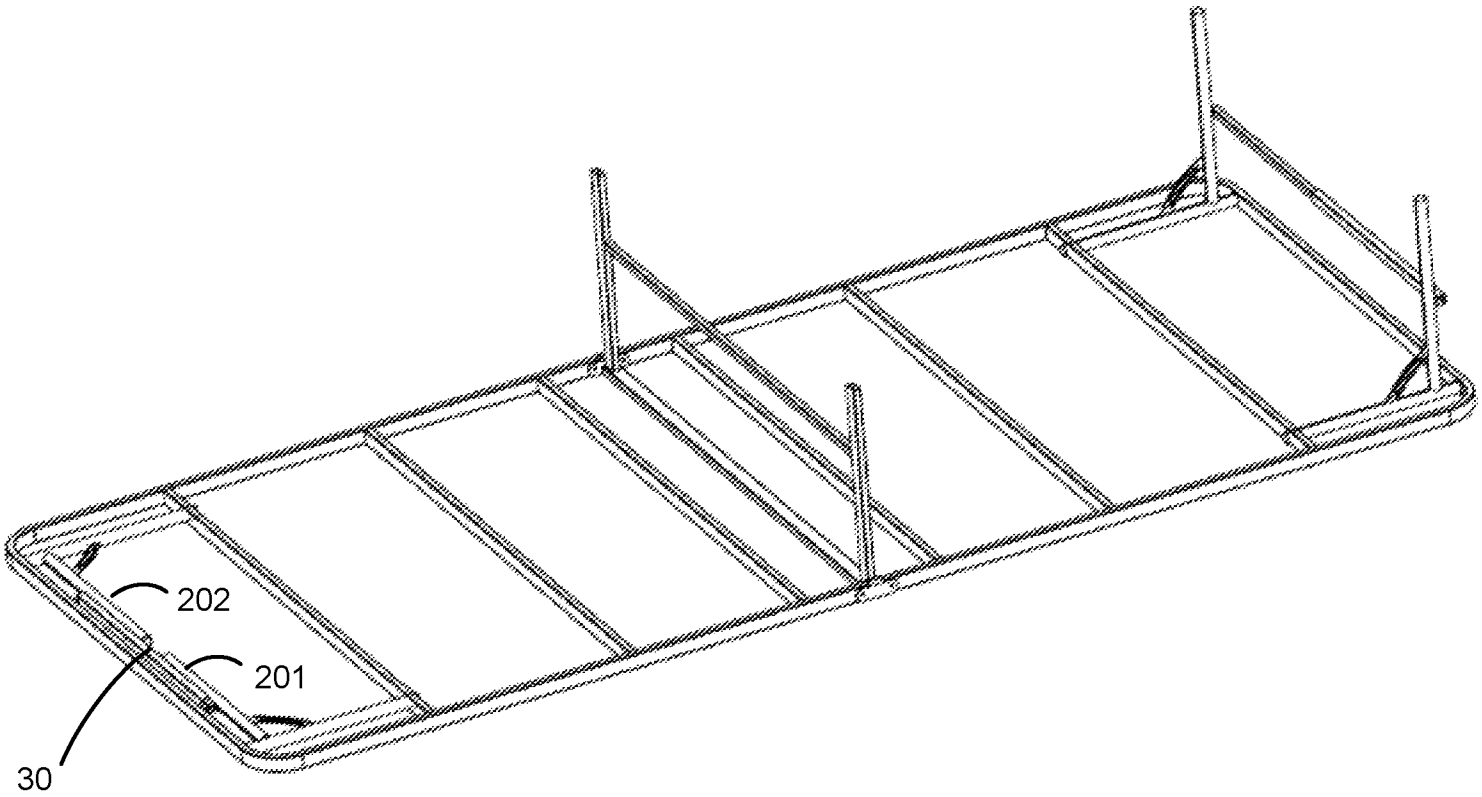
Figure 6:
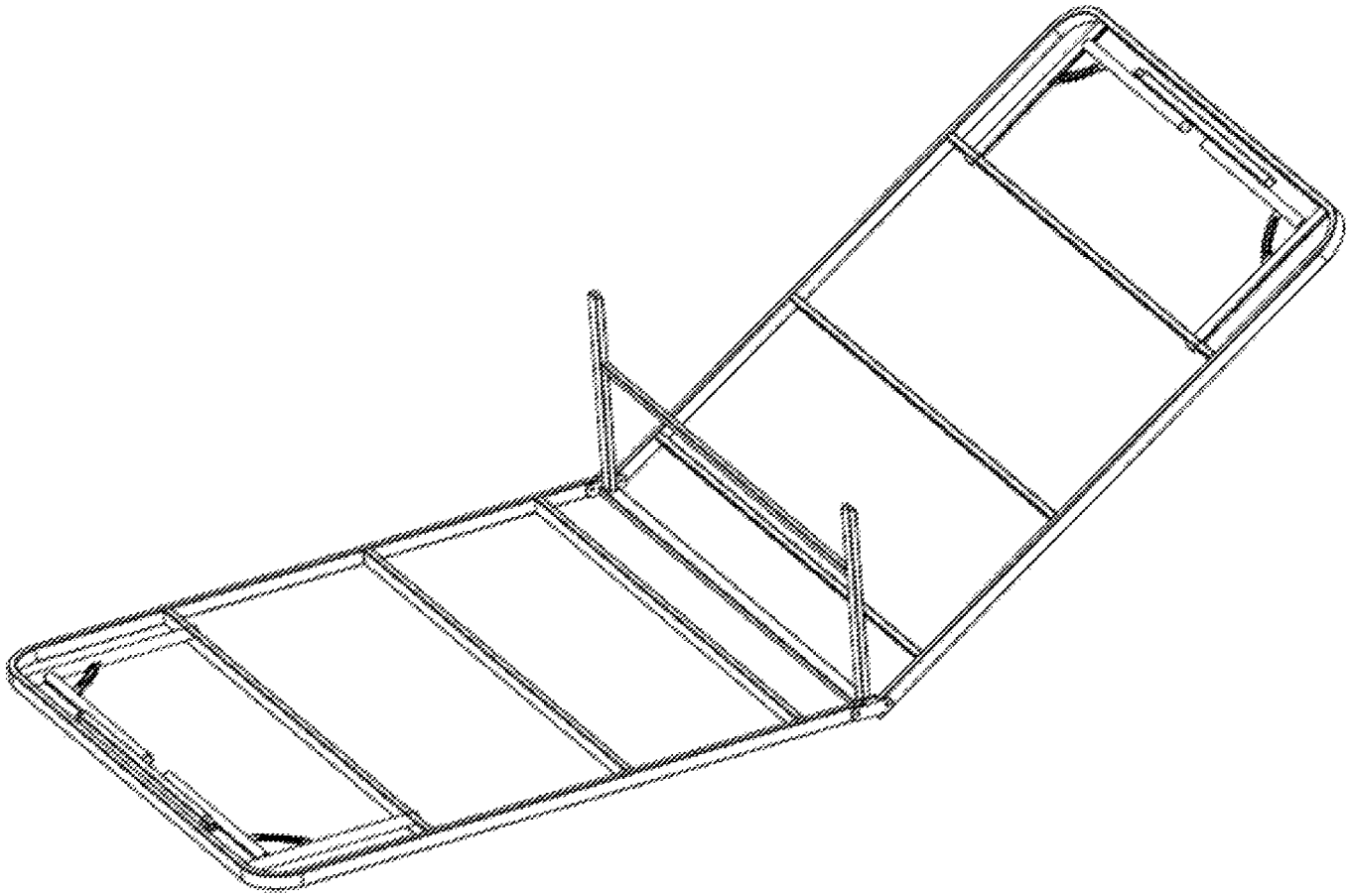
Figure 7:
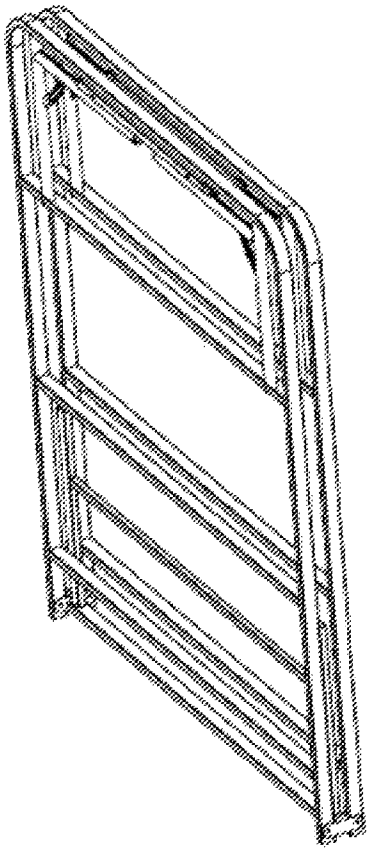

FIGS. 3-7 illustrate an exemplary process to fold the bed frame of FIG. 1. First, as illustrated in FIG. 3, uncouple the first tube and the second tube (e.g., pressing to release the fastener from the through hole of the second tube or from the through holes of both the first and second tubes) to allow the first and second tubes to move with respect to each other. In this state, left and right legs 201, 202 are free to move toward or away from each other. As an example, FIG. 4 illustrates a state in which right leg 202 is folded. FIG. 5 illustrates a state in which left and right legs 201, 202 are folded. FIG. 6 illustrates folding of sub-frames toward each other. FIG. 7 illustrates the exemplary foldable bed frame of the present invention in a folded state.

Figure 12:
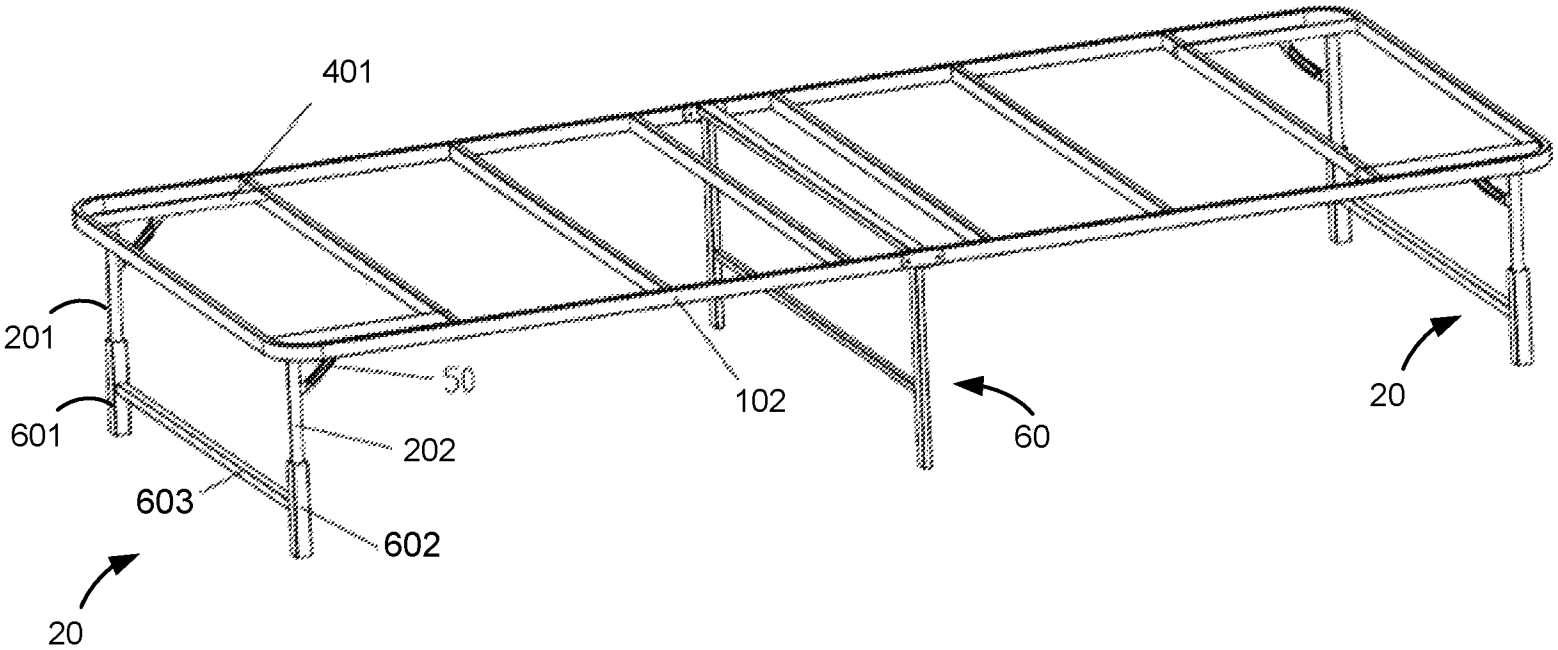
FIG. 12 is a perspective top view illustrating a foldable bed frame in an unfolded state in accordance with exemplary embodiments of the present invention.
Figure 13:
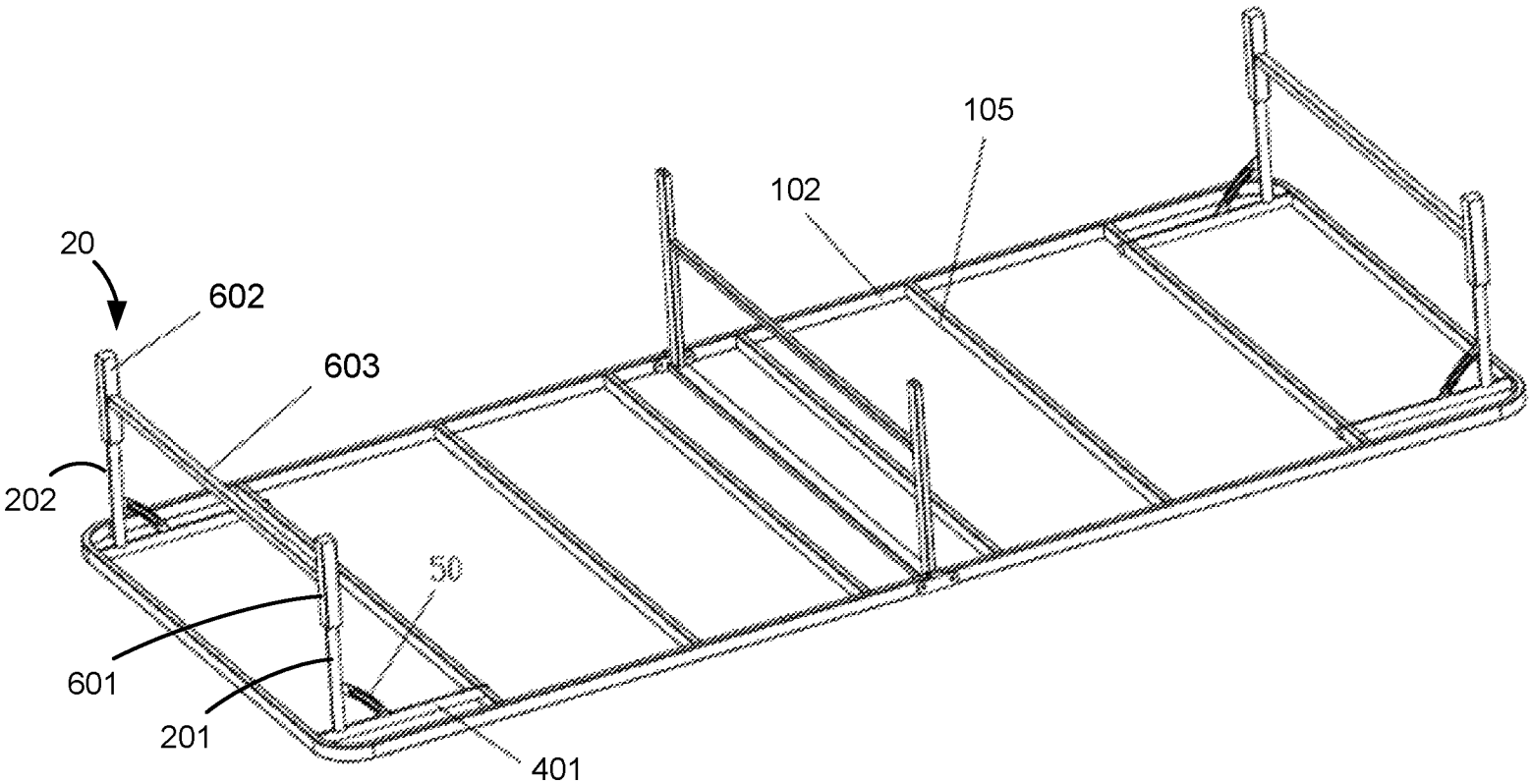
FIG. 13 is a perspective bottom view illustrating the foldable bed frame of FIG. 12.

Referring to FIGS. 12 and 13, there is depicted an alternative bed frame of the present invention in accordance with certain exemplary embodiments, in which first and second leg assemblies 20 do not include adjustable lateral bars. Instead, one or each of first and second leg assemblies 20 further includes a left leg base such as left leg base 601 removably coupled to left leg 201 and a right leg base such as right leg base 602 removably coupled to right leg 602. In an embodiment, one or each of first and second leg assemblies 20 further includes a base lateral bar such as base lateral bar 603, having a left end connected to left leg base 601 and a right end connected to right leg base 602. Through left and right leg base 601, 602, base lateral bar 603 holds left and right legs 201, 202 in place and prevents them from rotating toward or away from each other. As such, the bed frame of the present invention is stable when in use.

Figure 14:
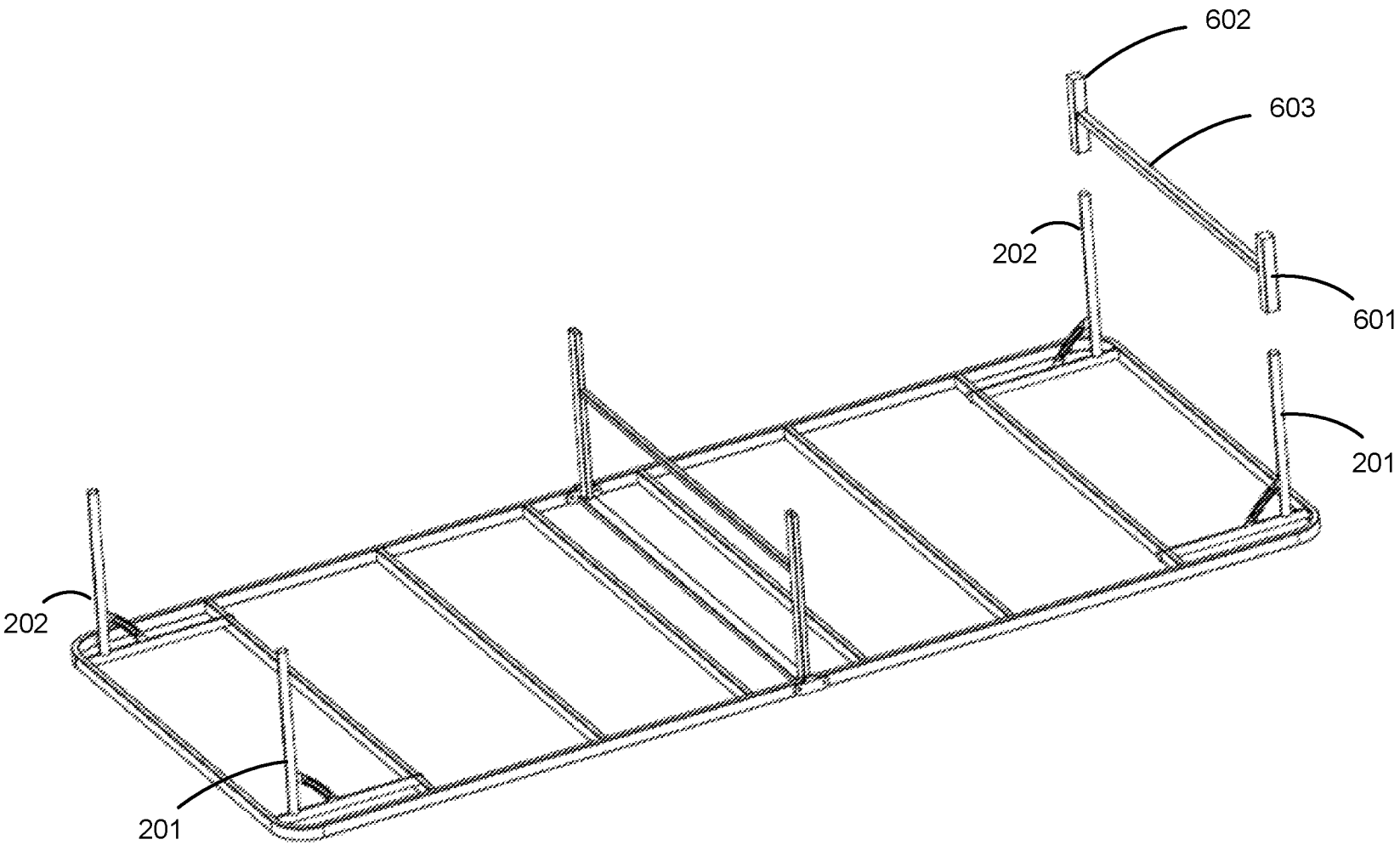
FIGS. 14-18 are perspective views illustrating exemplary folding processes of the foldable bed frame of FIG. 12.
Figure 15:
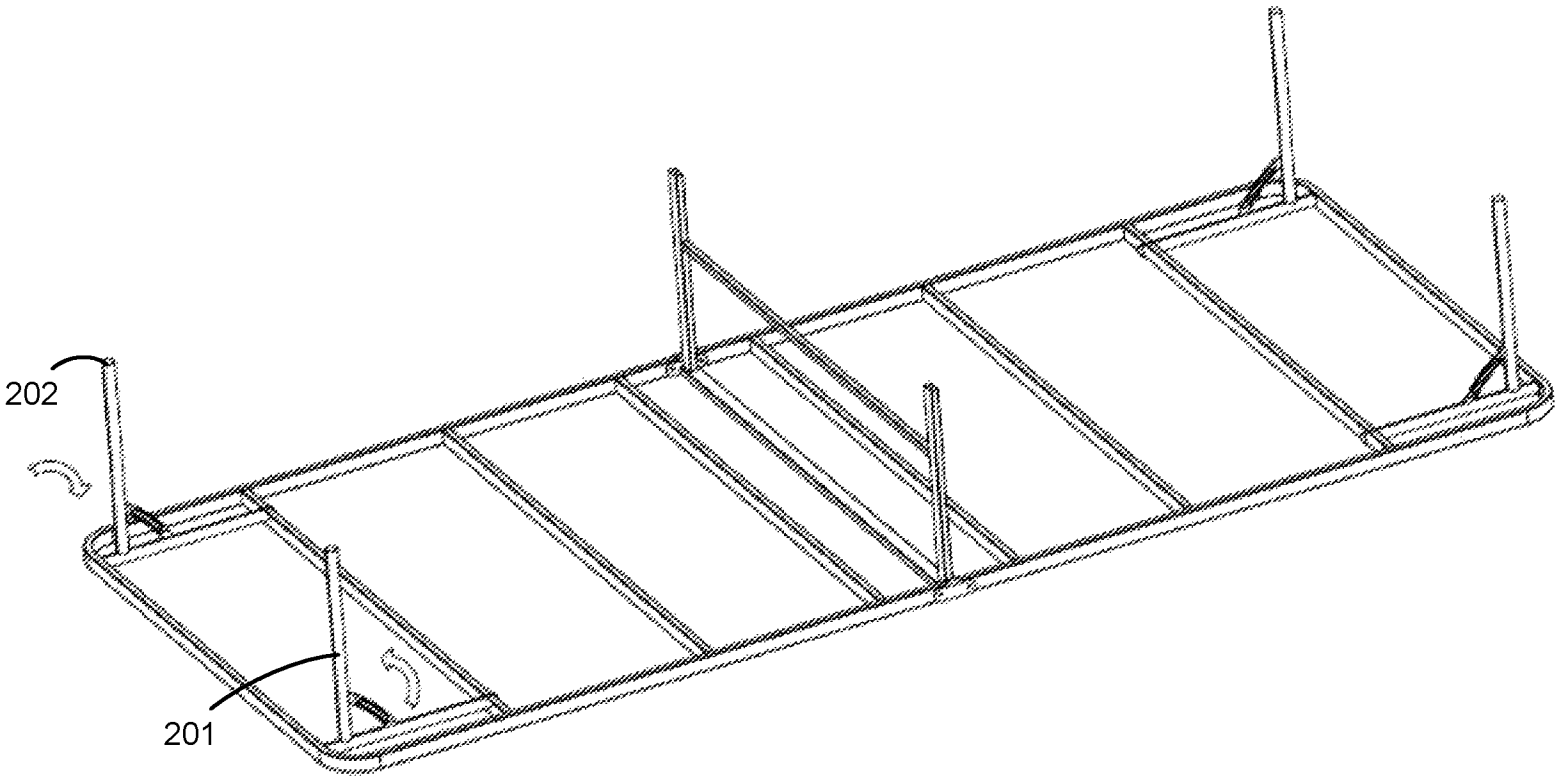
Figure 16:
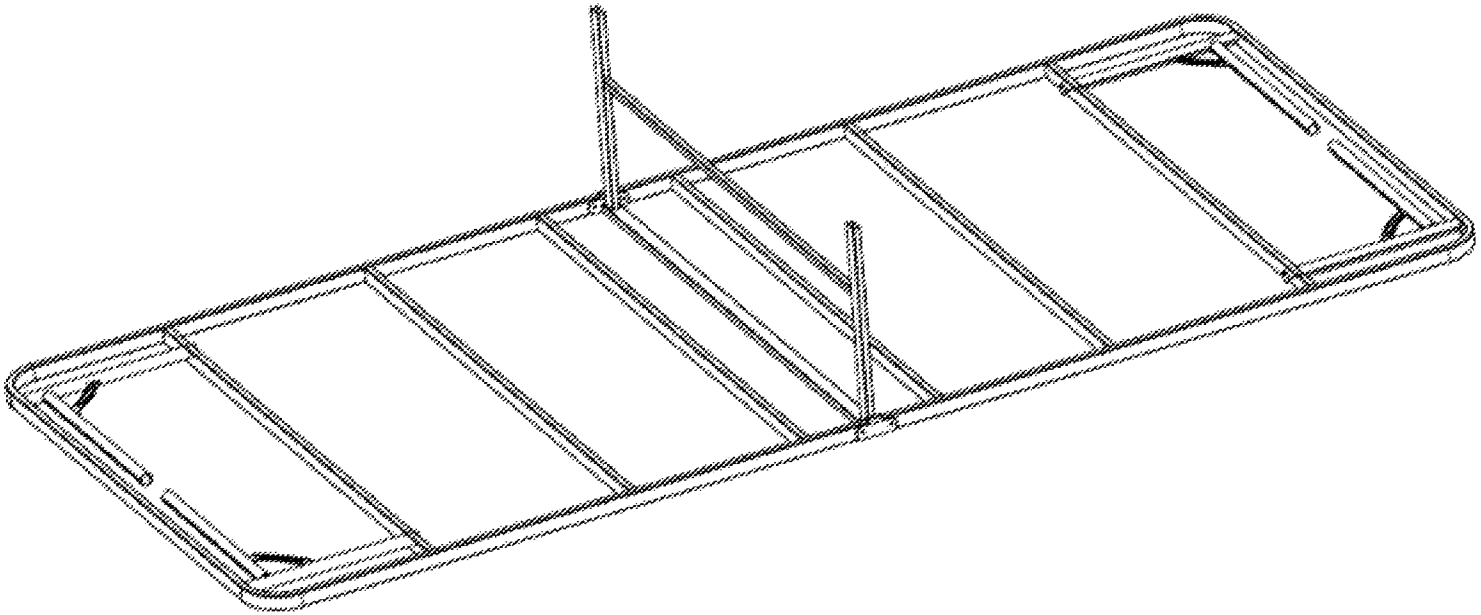
Figure 17:
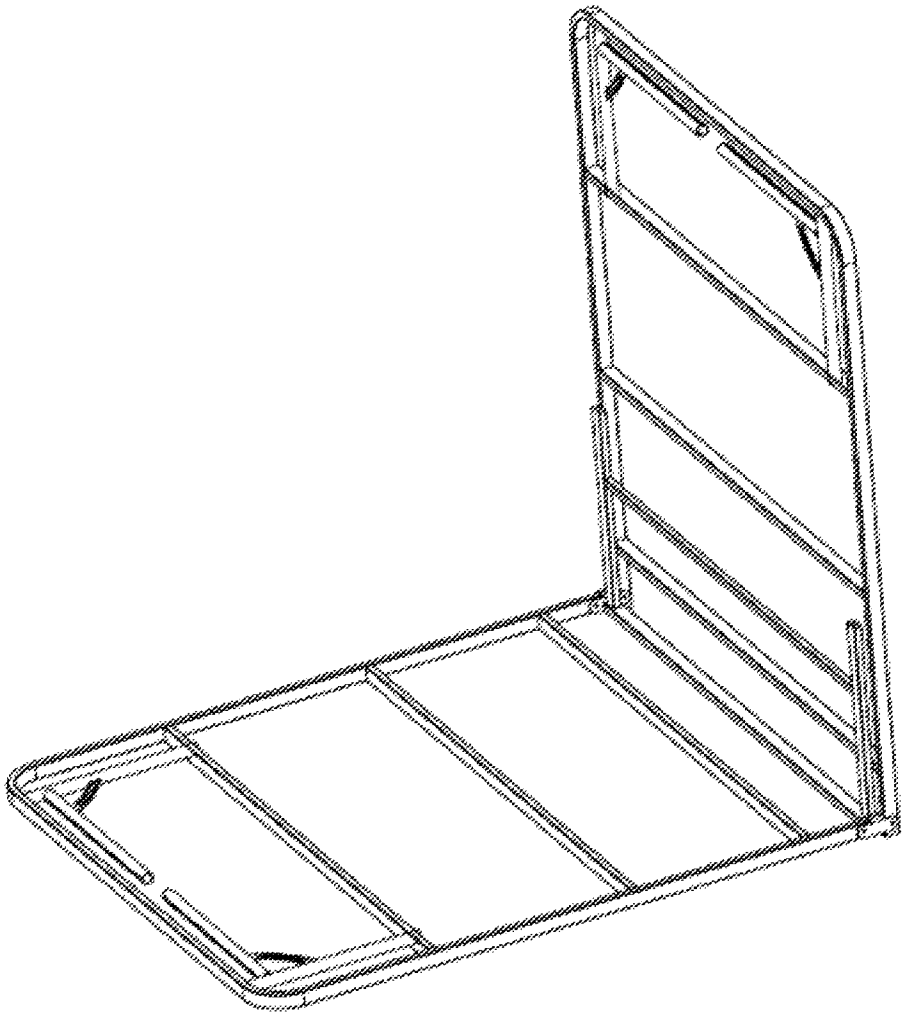
Figure 18:
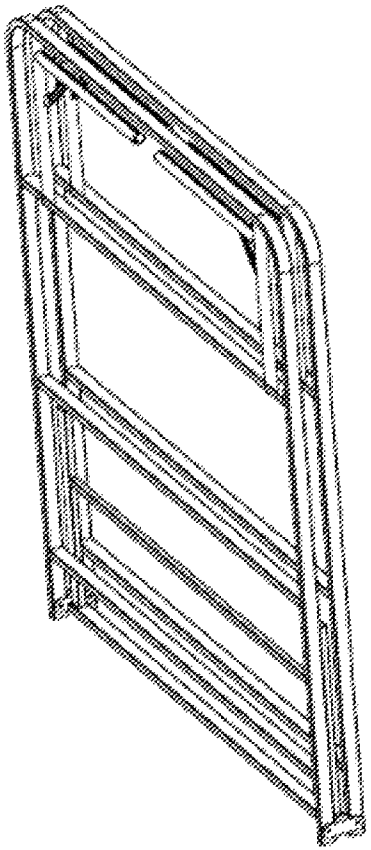

FIGS. 14-18 illustrate an exemplary process to fold the bed frame of FIG. 12. First remove left and right leg bases 601, 602 from left and right legs 201, 202, as illustrated in FIG. 14. Rotate left and right legs 201, 202 toward each other or toward longitudinal central line of the bed frame, as illustrated in FIG. 15. Once left and right legs 201, 202 are folded as shown in FIG. 16, fold sub-frames 10 as illustrated in FIG. 17. FIG. 18 illustrates the exemplary foldable bed frame of the present invention in a folded state.

In some embodiments, the bed frame of the present invention includes additional, optional, or alternative components. For instance, in some embodiments such as those illustrated in FIGS. 8 and 19, each of the first and second sub-frames further includes proximal lateral bar 106, second inner lateral bar 107, second left rotating bar 403, and second right rotating bar 404. Proximal lateral bar 106 is coupled to proximal ends (or end portions) of the left and right longitudinal bars. Second inner lateral bar 107 is disposed adjacent the proximal lateral bar, and having a left end coupled to left longitudinal bar 101 and a right end coupled to right longitudinal bar 102. Second left rotating bar 403 is disposed adjacent left longitudinal bar 101, and having a first end rotatably coupled to the proximal lateral bar and a second end rotatably coupled to the second inner lateral bar. Second right rotating bar 404 is disposed adjacent right longitudinal bar 102, and having a first end rotatably coupled to the proximal lateral bar and the second end rotatably coupled to the second inner lateral bar. The plurality of leg assemblies further includes third and fourth leg assemblies 20 disposed at the proximal sides of the first and second sub-frames, respectively. Like the first and second leg assemblies, each of the third and fourth leg assemblies includes left and right legs fixedly coupled to the second left and right rotating bars, respectively. As such, like the first and second leg assemblies, the left and right legs of third and the fourth leg assemblies can rotate in the lateral direction of the foldable bed frame toward or away from each other, respectively.

Figure 8:
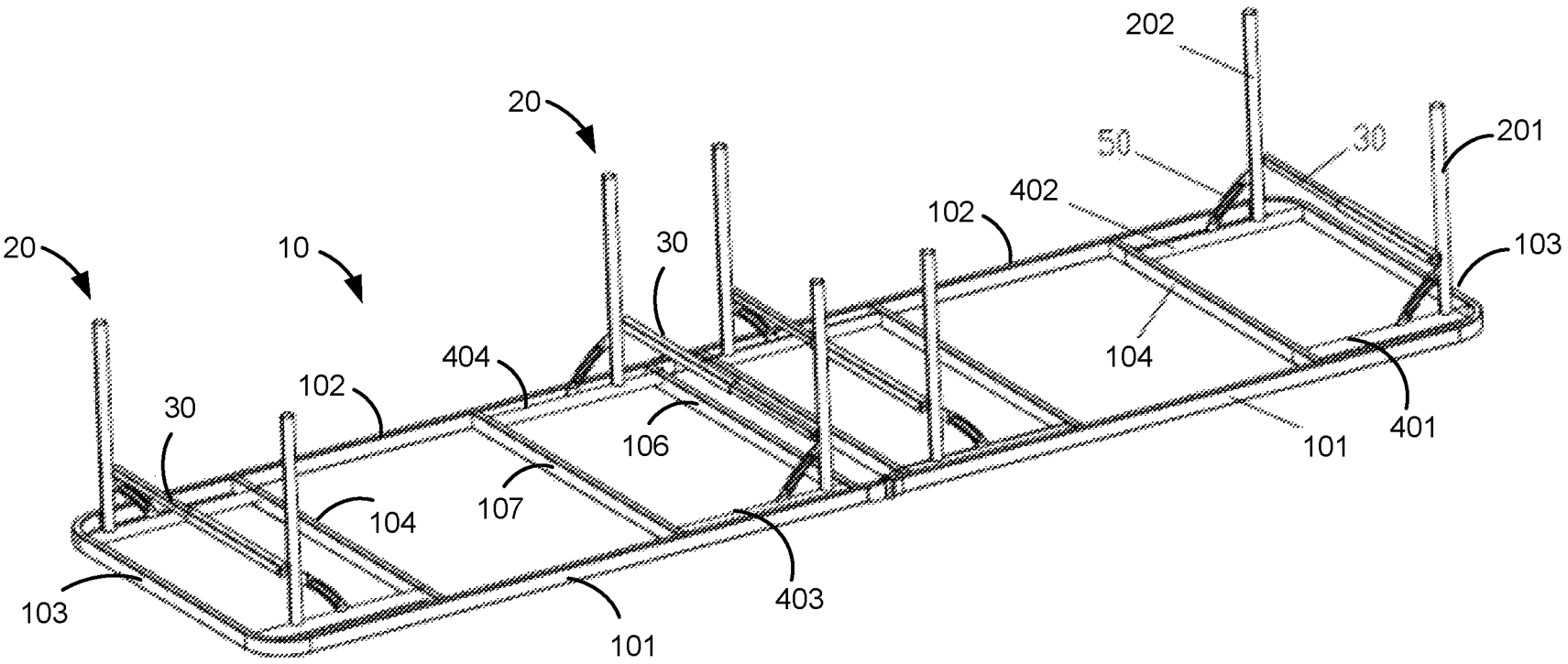
FIG. 8 is a perspective bottom view illustrating a foldable bed frame in an unfolded state in accordance with exemplary embodiments of the present invention.

In an embodiment such as that illustrated in FIG. 8, each of third and fourth leg assemblies 20 is configured the same or similar to the first and second leg assemblies 20 disclosed herein with respect to the embodiments of FIGS. 1 and 2. For instance, each of third and fourth leg assemblies 20 further includes an adjustable lateral bar such as adjustable lateral bar 30, having a left end connected to the left leg and a right end connected to the right leg.

Figure 19:
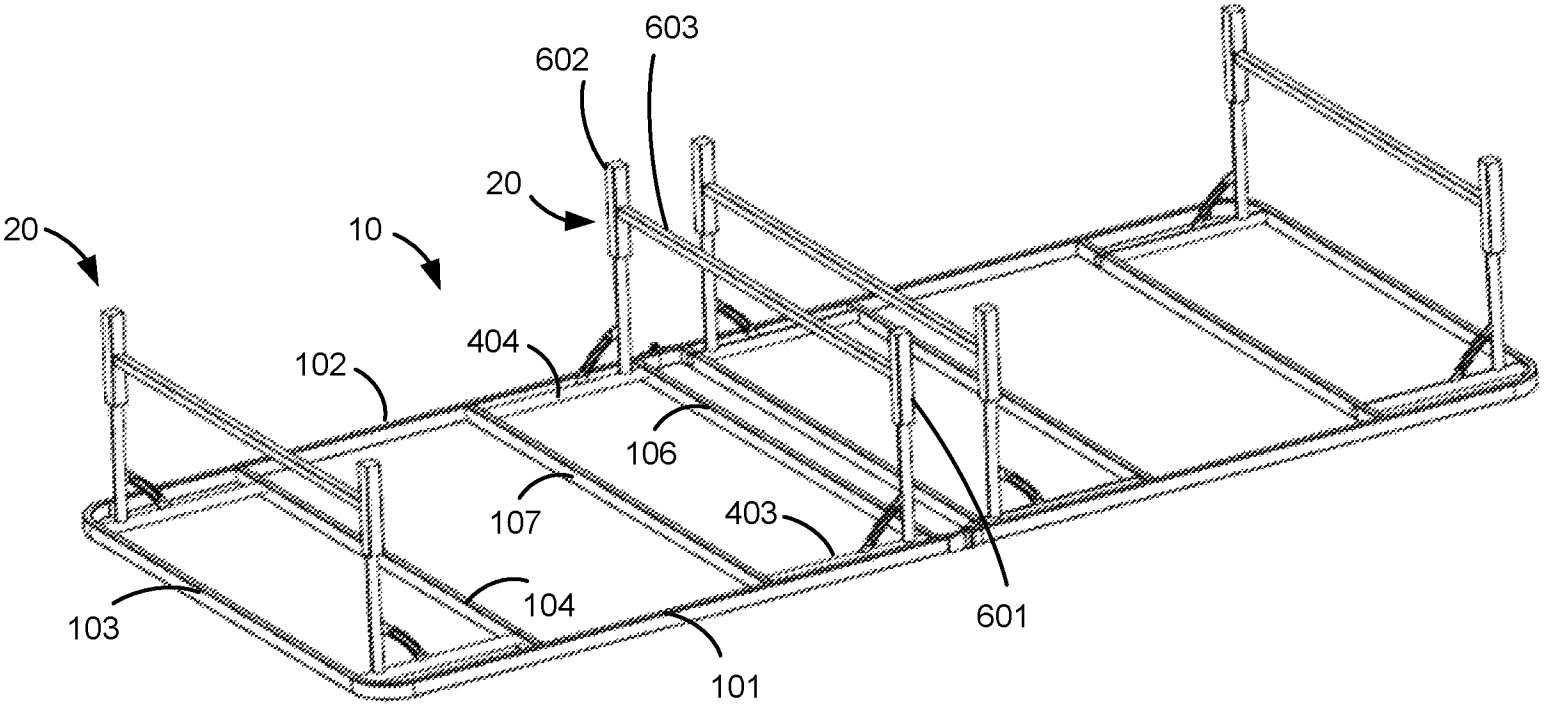
FIG. 19 is a perspective bottom view illustrating a foldable bed frame in an unfolded state in accordance with exemplary embodiments of the present invention.

In an embodiment such as that illustrated in FIG. 19, each of the third and fourth leg assemblies 20 is configured the same or similar to the first and second leg assemblies 20 disclosed herein with respect to the embodiments of FIGS. 12 and 13. For instance, each of third and fourth leg assemblies 20 further includes left leg base 601 removably coupled to the left leg and right leg base 602 removably coupled to the right leg. In an embodiment, each of the third and fourth leg assemblies further includes base lateral bar 603 having a left end connected to the left leg base and a right end connected to the right leg base.

By way of example, the figures disclosed herein illustrate each foldable bed frame including either leg assembly 20 disclosed herein with respect to the embodiments of FIGS. 1 and 2, or leg assembly 20 disclosed herein with respect to the embodiments of FIGS. 12 and 13. It should be noted that a foldable bed frame of the present invention can include a combination of both types of leg assemblies, and/or similar leg assemblies in the same bed frame.

As disclosed herein, legs of the bed frame of the present invention are fixedly coupled to rotating bars, and cannot be rotated in the longitudinal direction of the bed frame. In some embodiments, the bed frame of the present invention further includes supports 50 that prevent the legs from shaking or rotating in the longitudinal direction of the bed frame. In some embodiments, the bed frame of the present invention further includes adjustable lateral bars 30 or base lateral bars 603 that prevent left and right legs 201, 202 from shaking or rotating in the lateral direction of the bed frame when the bed frame is unfolded or in use. Thus, the legs 201, 202 are held in place solidly (e.g., substantially vertical with respect to a ground) when in use, making the bed frames more stable, more reliable, and thus safer to use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "left" or "right", "longitudinal" or "lateral", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first sub-frame could be termed a second sub-frame, and, similarly, a second sub-frame could be termed a first sub-frame, without changing the meaning of the description, so long as all occurrences of the "first sub-frame" are renamed consistently and all occurrences of the "second sub-frame" are renamed consistently.

What is claimed is:

1. A foldable bed frame comprising:

first and second sub-frames pivotally connected to each other at proximal sides thereof; and a plurality of leg assemblies comprising a first leg assembly disposed at a distal side of the first sub-frame and connected with the first sub-frame, and a second leg assembly disposed at a distal side of the second sub-frame and connected with the second sub-frame, wherein each of the first and second leg assemblies comprises left and right legs disposed at left and right sides of the foldable bed frame, respectively, and an adjustable lateral bar having a left end connected to the left leg and a right end connected to the right leg, wherein a length of the adjustable lateral bar is extendable and contractible to allow the left and right legs to rotate in a lateral direction of the foldable bed frame toward or away from each other while the left and right legs are connected with the respective first or second sub-frame and connected with the adjustable lateral bar.

2. The foldable bed frame of claim 1, wherein the plurality of leg assemblies further comprises a middle leg assembly disposed between the first and second sub-frames and rotatably coupled to the first and second sub-frames.

3. A foldable bed frame comprising:

first and second sub-frames pivotally connected to each other at proximal sides thereof, wherein each of the first and second sub-frames comprises:

a left longitudinal bar;

a right longitudinal bar;

a distal lateral bar coupled to distal ends of the left and right longitudinal bars, wherein the left longitudinal bar, the right longitudinal bar, and the distal lateral bar are coupled to or integrally formed with each other, and collectively form an outer frame;

a first inner lateral bar disposed adjacent the distal lateral bar, and having a left end coupled to the left longitudinal bar and a right end coupled to the right longitudinal bar, wherein the first inner lateral bar is separate and distinct from the distal lateral bar;

a first left rotating bar disposed within the outer frame and adjacent the left longitudinal bar, and having a first end rotatably coupled to the distal lateral bar and a second end rotatably coupled to the first inner lateral bar; and a first right rotating bar disposed within the outer frame and adjacent the right longitudinal bar, and having a first end rotatably coupled to the distal lateral bar and the second end rotatably coupled to the first inner lateral bar; and a plurality of leg assemblies comprising a first leg assembly disposed at a distal side of the first sub-frame, and a second leg assembly disposed at a distal side of the second sub-frame;

wherein each of the first and second leg assemblies comprises left and right legs disposed at left and right sides of the foldable bed frame, respectively, and able to rotate in a lateral direction of the foldable bed frame toward or away from each other;

wherein upper ends of the left and right legs of the first or second leg assembly are fixedly coupled to the first left and right rotating bars, respectively.

4. The foldable bed frame of claim 3, wherein each of the first and second sub-frames further comprises one or more inner lateral bars, each having a left end coupled to the left longitudinal bar and a right end coupled to the right longitudinal bar.

5. The foldable bed frame of claim 1, wherein the left longitudinal bar, the right longitudinal bar, and the distal lateral bar are integrally formed and collectively form a U-shaped outer frame.

6. A foldable bed frame comprising:

first and second sub-frames pivotally connected to each other at proximal sides thereof, wherein each of the first and second sub-frames comprises:

a left longitudinal bar;

a right longitudinal bar;

a distal lateral bar coupled to distal ends of the left and right longitudinal bars;

a first inner lateral bar disposed adjacent the distal lateral bar, and having a left end coupled to the left longitudinal bar and a right end coupled to the right longitudinal bar;

a first left rotating bar disposed adjacent the left longitudinal bar, and having a first end rotatably coupled to the distal lateral bar and a second end rotatably coupled to the first inner lateral bar; and a first right rotating bar disposed adjacent the right longitudinal bar, and having a first end rotatably coupled to the distal lateral bar and the second end rotatably coupled to the first inner lateral bar; and a plurality of leg assemblies comprising a first leg assembly disposed at a distal side of the first sub-frame, and a second leg assembly disposed at a distal side of the second sub-frame;

wherein each of the first and second leg assemblies comprises left and right legs disposed at left and right sides of the foldable bed frame, respectively, and able to rotate in a lateral direction of the foldable bed frame toward or away from each other;

wherein upper ends of the left and right legs of the first or second leg assembly are fixedly coupled to the first left and right rotating bars, respectively;

wherein:

each of the first and second sub-frames further comprises:

a proximal lateral bar coupled to proximal ends of the left and right longitudinal bars;

a second inner lateral bar disposed adjacent the proximal lateral bar, and having a left end coupled to the left longitudinal bar and a right end coupled to the right longitudinal bar;

a second left rotating bar disposed adjacent the left longitudinal bar, and having a first end rotatably coupled to the proximal lateral bar and a second end rotatably coupled to the second inner lateral bar; and a second right rotating bar disposed adjacent the right longitudinal bar, and having a first end rotatably coupled to the proximal lateral bar and the second end rotatably coupled to the second inner lateral bar; and the plurality of leg assemblies further comprises:

a third leg assembly disposed at the proximal side of the first sub-frame; and a fourth leg assembly disposed at the proximal side of the second sub-frame, wherein each of the third and fourth leg assemblies comprises left and right legs disposed at left and right sides of the foldable bed frame, respectively, and able to rotate in the lateral direction of the foldable bed frame toward or away from each other.

7. A foldable bed frame comprising:

first and second sub-frames pivotally connected to each other at proximal sides thereof, wherein each of the first and second sub-frames comprises:

a left longitudinal bar;

a right longitudinal bar;

a distal lateral bar coupled to distal ends of the left and right longitudinal bars;

a first inner lateral bar disposed adjacent the distal lateral bar, and having a left end coupled to the left longitudinal bar and a right end coupled to the right longitudinal bar;

a first left rotating bar disposed adjacent the left longitudinal bar, and having a first end rotatably coupled to the distal lateral bar and a second end rotatably coupled to the first inner lateral bar; and a first right rotating bar disposed adjacent the right longitudinal bar, and having a first end rotatably coupled to the distal lateral bar and the second end rotatably coupled to the first inner lateral bar; and a plurality of leg assemblies comprising a first leg assembly disposed at a distal side of the first sub-frame, and a second leg assembly disposed at a distal side of the second sub-frame;

wherein each of the first and second leg assemblies comprises left and right legs disposed at left and right sides of the foldable bed frame, respectively, and able to rotate in a lateral direction of the foldable bed frame toward or away from each other;

wherein upper ends of the left and right legs of the first or second leg assembly are fixedly coupled to the first left and right rotating bars, respectively;

wherein:

each of the first and second ends of the first left and right rotating bars has a cross section of an oval shape with a longer axis and a shorter axis;

corresponding to each of the first ends of the first left and right rotating bars, the distal lateral bar comprises a hole of an oval shape with a longer axis and a shorter axis; and corresponding to each of the second ends of the left and right rotating bars, the first inner lateral bar comprises a hole of an oval shape with a longer axis and a shorter axis, wherein the first and second ends of the first left and right rotating bars are received in the holes of the distal and first inner lateral bars, and are press-fitted with the corresponding holes of the distal and first inner lateral bars when the longer axes of the first and second ends of the first left and right rotating bars are aligned with the shorter axes of the corresponding holes of the distal and inner lateral bars.

8. The foldable bed frame of claim 7, wherein the longer axis of each of the first ends of the first left and right rotating bars has a length equal to a length of the shorter axis of the corresponding hole of the distal lateral bar, and the longer axis of each of the second ends of the first left and right rotating bars has a length equal to a length of the shorter axis of the corresponding hole of the inner lateral bar.

9. A foldable bed frame comprising:

first and second sub-frames pivotally connected to each other at proximal sides thereof, wherein each of the first and second sub-frames comprises:

a left longitudinal bar;

a right longitudinal bar;

a distal lateral bar coupled to distal ends of the left and right longitudinal bars;

a first inner lateral bar disposed adjacent the distal lateral bar, and having a left end coupled to the left longitudinal bar and a right end coupled to the right longitudinal bar;

a first left rotating bar disposed adjacent the left longitudinal bar, and having a first end rotatably coupled to the distal lateral bar and a second end rotatably coupled to the first inner lateral bar; and a first right rotating bar disposed adjacent the right longitudinal bar, and having a first end rotatably coupled to the distal lateral bar and the second end rotatably coupled to the first inner lateral bar; and a plurality of leg assemblies comprising a first leg assembly disposed at a distal side of the first sub-frame, and a second leg assembly disposed at a distal side of the second sub-frame;

wherein each of the first and second leg assemblies comprises left and right legs disposed at left and right sides of the foldable bed frame, respectively, and able to rotate in a lateral direction of the foldable bed frame toward or away from each other;

wherein upper ends of the left and right legs of the first or second leg assembly are fixedly coupled to the first left and right rotating bars, respectively;

wherein:

each of the first left and right rotating bars has a cross section of an oval shape with a longer axis and a shorter axis; and corresponding to each of the first left and right rotating bars, the distal lateral bar comprises a hole of an oval shape with a longer axis and a shorter axis, and the first inner lateral bar comprises a hole of an oval shape with a longer axis and a shorter axis, wherein the first and second ends of the first left and right rotating bars are received in the holes of the distal and first inner lateral bars, and are press-fitted with the corresponding holes of the distal and first inner lateral bars when the longer axes of the first left and right rotating bars are aligned with the shorter axes of the corresponding holes of the distal and inner lateral bars.

10. A foldable bed frame comprising:

first and second sub-frames pivotally connected to each other at proximal sides thereof, wherein each of the first and second sub-frames comprises:

a left longitudinal bar;

a right longitudinal bar;

a distal lateral bar coupled to distal ends of the left and right longitudinal bars;

a first inner lateral bar disposed adjacent the distal lateral bar, and having a left end coupled to the left longitudinal bar and a right end coupled to the right longitudinal bar;

a first left rotating bar disposed adjacent the left longitudinal bar, and having a first end rotatably coupled to the distal lateral bar and a second end rotatably coupled to the first inner lateral bar; and a first right rotating bar disposed adjacent the right longitudinal bar, and having a first end rotatably coupled to the distal lateral bar and the second end rotatably coupled to the first inner lateral bar;

a plurality of leg assemblies comprising a first leg assembly disposed at a distal side of the first sub-frame, and a second leg assembly disposed at a distal side of the second sub-frame; and a plurality of supports, each having a first end fixedly coupled to the left or right leg and a second end fixedly coupled to the corresponding first left or right rotating bar;

wherein each of the first and second leg assemblies comprises left and right legs disposed at left and right sides of the foldable bed frame, respectively, and able to rotate in a lateral direction of the foldable bed frame toward or away from each other;

wherein upper ends of the left and right legs of the first or second leg assembly are fixedly coupled to the first left and right rotating bars, respectively.

11. A foldable bed frame comprising:

first and second sub-frames pivotally connected to each other at proximal sides thereof, wherein each of the first and second sub-frames comprises:

a left longitudinal bar;

a right longitudinal bar;

a distal lateral bar coupled to distal ends of the left and right longitudinal bars;

a first inner lateral bar disposed adjacent the distal lateral bar, and having a left end coupled to the left longitudinal bar and a right end coupled to the right longitudinal bar;

a first left rotating bar disposed adjacent the left longitudinal bar, and having a first end rotatably coupled to the distal lateral bar and a second end rotatably coupled to the first inner lateral bar; and a first right rotating bar disposed adjacent the right longitudinal bar, and having a first end rotatably coupled to the distal lateral bar and the second end rotatably coupled to the first inner lateral bar; and a plurality of leg assemblies comprising a first leg assembly disposed at a distal side of the first sub-frame, and a second leg assembly disposed at a distal side of the second sub-frame;

wherein each of the first and second leg assemblies comprises left and right legs disposed at left and right sides of the foldable bed frame, respectively, and able to rotate in a lateral direction of the foldable bed frame toward or away from each other;

wherein upper ends of the left and right legs of the first or second leg assembly are fixedly coupled to the first left and right rotating bars, respectively;

wherein each of the first and second leg assemblies further comprises an adjustable lateral bar having a left end connected to the left leg and a right end connected to the right leg.

12. The foldable bed frame of claim 11, wherein the adjustable lateral bar comprises first and second tubes telescopically coupled to each other and a fastening means for fixing the first tube to the second tube.

13. The foldable bed frame of claim 6, wherein each of the third and fourth leg assemblies further comprises an adjustable lateral bar having a left end connected to the left leg and a right end connected to the right leg.

14. The foldable bed frame of claim 13, wherein the adjustable lateral bar comprises first and second tubes telescopically coupled to each other and a fastening means for fixating the first tube with the second tube.

15. The foldable bed frame of claim 3, wherein each of the first and second leg assemblies further comprises a left leg base removably coupled to the left leg and a right leg base removably coupled to the right leg.

16. The foldable bed frame of claim 15, wherein each of the first and second leg assemblies further comprises a base lateral bar having a left end connected to the left leg base and a right end connected to the right leg base.

17. The foldable bed frame of claim 6, wherein each of the third and fourth leg assemblies further comprises a left leg base removably coupled to the left leg and a right leg base removably coupled to the right leg.

18. The foldable bed frame of claim 17, wherein each of the third and fourth leg assemblies further comprises a base lateral bar having a left end connected to the left leg base and a right end connected to the right leg base.

* * * * *